US011499279B1

(12) United States Patent
Lamore

(10) Patent No.: US 11,499,279 B1
(45) Date of Patent: Nov. 15, 2022

(54) SHALLOW-MOUNT BRACED-POST BARRIER

(71) Applicant: Barrier1 Systems, LLC, Greensboro, NC (US)

(72) Inventor: Michael John Lamore, Greensboro, NC (US)

(73) Assignee: Barrier1 Systems, LLC, Greensboro, NC (US)

( * ) Notice: Subject to any disclaimer, the term of this patent is extended or adjusted under 35 U.S.C. 154(b) by 183 days.

(21) Appl. No.: 16/787,206

(22) Filed: Feb. 11, 2020

(51) Int. Cl.
*E01F 15/14* (2006.01)
*E01F 15/00* (2006.01)

(52) U.S. Cl.
CPC ..... *E01F 15/14* (2013.01); *E01F 15/003* (2013.01)

(58) Field of Classification Search
CPC ..... E01F 15/003; E01F 15/14; E04H 17/08
USPC ..... 404/6, 72
See application file for complete search history.

(56) References Cited

U.S. PATENT DOCUMENTS 158,941 A * 1/1875 Hogue ..... E01F 13/02 256/64
621,000 A * 3/1899 Warner ..... E04H 17/08 256/35
769,967 A * 9/1904 Warner ..... E04H 12/2276 52/149
1,241,041 A * 9/1917 Slick ..... E01F 15/0438 256/13.1
1,449,518 A * 3/1923 Lawson ..... E01F 15/0438 256/13.1
1,677,038 A * 7/1928 Lookabaugh ..... E01F 15/025 256/13.1
1,795,247 A * 3/1931 Burns ..... E01F 15/003 256/13.1
1,913,715 A * 6/1933 Macdonald ..... E01F 15/06 256/13.1
(Continued)

FOREIGN PATENT DOCUMENTS

CA 2852178 A1 5/2013
DE 3036227 A1 10/1982
(Continued)

OTHER PUBLICATIONS

Lamore, U.S. Appl. No. 17/524,309 for "Shallow-mount, Stand-alone Security Bollard" filed Nov. 11, 2021, pp. 1-67.
(Continued)

*Primary Examiner* — Raymond W Addie
(74) *Attorney, Agent, or Firm* — Additon, Pendleton & Witherspoon, P.A.

(57) ABSTRACT

A barrier apparatus includes a barrier post mounted to a base and extending upwardly from the base. A brace of the barrier apparatus is configured to restrict relative movement between the barrier post and the base. The brace can be mounted to the base so that it extends upwardly and obliquely toward the barrier post. The brace can include block. A reinforcing tube can extend around the block. A mated connection to the front of the brace can include a first mating protrusion extending into a first mating hole, and a mated connection to the bottom of the brace can include a second mating protrusion extending into a second mating hole. The brace or another brace can extend into a rear corner positioned between the barrier post and the base.

23 Claims, 12 Drawing Sheets

(56) References Cited

U.S. PATENT DOCUMENTS 2,646,969 A * 7/1953 Hendrickson ..... E01F 15/0415 256/13.1
2,907,552 A * 10/1959 Crone ..... E04H 17/22 256/13.1
3,915,434 A 10/1975 Lister
5,228,237 A * 7/1993 Nasatka ..... E01F 13/085 404/6
5,406,663 A 4/1995 Chen
5,779,227 A * 7/1998 Elkins ..... E04H 17/18 256/24
5,836,715 A 11/1998 Hendrix et al.
6,176,062 B1 * 1/2001 Fayle ..... E01F 15/0469 405/216
6,409,419 B1 6/2002 Hernandez
6,948,283 B2 9/2005 Burkart et al.
7,118,304 B2 10/2006 Turpin et al.
7,278,240 B2 10/2007 Burkart et al.
7,549,259 B2 * 6/2009 Calle ..... E02D 27/42 52/155
7,607,856 B2 10/2009 Patel
7,699,558 B2 4/2010 Alder et al.
7,775,738 B2 * 8/2010 Darcy ..... E01F 13/12 404/6
8,197,156 B2 6/2012 Morgan et al.
8,215,865 B2 7/2012 Adler et al.
8,226,322 B2 7/2012 Blair
8,979,419 B2 3/2015 Heald
9,315,956 B2 4/2016 Heald
10,119,230 B2 11/2018 Heald
10,501,957 B1 12/2019 Borowiak
10,988,903 B1 * 4/2021 Neusch ..... E01F 15/003
11,174,606 B1 11/2021 Lamore
2008/0067484 A1 * 3/2008 Amengual Pericas ..... E01F 15/0476 256/13.1
2008/0296462 A1 12/2008 Siu
2009/0028638 A1 * 1/2009 Crawford ..... E01F 13/12 404/6
2016/0130775 A1 * 5/2016 Brackin ..... E01F 15/06 256/65.14
2018/0327995 A1 * 11/2018 Earhart ..... E04H 12/2269
2018/0371790 A1 * 12/2018 Westfahl ..... E04H 17/20
2019/0136470 A1 * 5/2019 Dickinson ..... E01F 13/12
2021/0012621 A1 * 1/2021 Anderson ..... G07F 19/201

FOREIGN PATENT DOCUMENTS

DE 3929247 C1 10/1990
EP 1070789 A1 1/2001
GB 607016 8/1948
GB 1480245 7/1977
GB 2229472 A 9/1990

OTHER PUBLICATIONS

Non-Final Office Action in commonly owned U.S. Appl. No. 16/407,277, dated Mar. 30, 2021, pp. 1-12.

* cited by examiner

SHALLOW-MOUNT BRACED-POST BARRIER

FIELD OF THE INVENTION

The present invention relates to barriers and, more particularly, to shallow-mount barriers that may be used to restrict vehicle access.

BACKGROUND

Barriers are frequently used to protect buildings, personnel, and critical assets against undesirable vehicle impacts, for example vehicle ramming attacks. Such security barriers typically include a steel base set in concrete within a hole in the ground, and an upright steel pipe extending from the base to above ground. For resisting high-energy vehicle impacts, it is typical for the hole, concrete foundation, and base to extend relatively deep into the ground.

In some situations, it can be difficult and/or inefficient to provide deep holes, deep concrete foundations, and deep bases of barriers. For example, underground rocks, underground utilities, tunnels, basements, subways, and/or other underground features may restrict the depth of barriers. Accordingly, there is a desire for a barrier and barrier systems that provide a new balance of properties (e.g., capabilities).

SUMMARY

An aspect of this disclosure is the provision of a barrier apparatus that is capable of being advantageously used as a shallow-mount security barrier. Notwithstanding, the barrier apparatus of this disclosure may be used in installations other than shallow-mount installations.

In an example, a barrier apparatus comprises: a base comprising a base plate, wherein the base is configured to be at least partially embedded in concrete and/or other suitable substrate material; a barrier post mounted to the base and extending upwardly from the base; and a brace configured to restrict relative movement between the barrier post and the base plate, wherein the brace is mounted to the base and extends upwardly and obliquely toward the barrier post, so that the brace extends obliquely between the base and the barrier post. The brace can be in the form of a tube (e.g., steel pipe) extending around a block, and one or more mating protrusions can extend from opposite ends of the block into respective mating holes for at least partially mounting the brace. At least a portion of the brace can be configured to extend to an elevation above an upper surface of the concrete and/or other suitable substrate material. Optionally, the brace and/or a second brace can extend downwardly at least partially into a rear corner positioned between the barrier post and the base.

In another example, a barrier apparatus comprises: a base comprising a base plate, wherein the base is configured to be at least partially embedded in concrete and/or other suitable substrate material; a barrier post mounted to the base and extending upwardly from the base; and a brace comprising a block configured to restrict relative movement between the barrier post and the base plate, wherein the brace is mounted to the base and extends at least partially into a rear corner positioned between the barrier post and the base.

In an additional example, a barrier apparatus comprises: a base comprising a base plate, the base being configured to be at least partially embedded in concrete and/or other suitable substrate material; a barrier post mounted to the base and extending upwardly from the base; and a brace mounted between the barrier post and the base plate, wherein the brace is configured to restrict relative movement between the barrier post and the base plate, a mated connection to the front of the brace comprises a first mating protrusion extending into a first mating hole, and a mated connection to the bottom of the brace comprises a second mating protrusion extending into a second mating hole.

The foregoing summary provides a few brief examples and is not exhaustive, and the present invention is not limited to the foregoing examples. The foregoing examples, as well as other examples, are further explained in the following detailed description with reference to accompanying drawings.

BRIEF DESCRIPTION OF THE DRAWINGS

The drawings are provided as examples. The present invention may be embodied in many different forms and should not be construed as limited to the examples depicted in the drawings.

DETAILED DESCRIPTION

Examples of embodiments are disclosed in the following. The present invention may, however, be embodied in many different forms and should not be construed as limited to the embodiments set forth herein. For example, features disclosed as part of one embodiment or example can be used in the context of another embodiment or example to yield a further embodiment or example. As another example of the breadth of this disclosure, it is within the scope of this disclosure for one or more of the terms "substantially," "about," "approximately," and/or the like, to qualify each of the adjectives and adverbs of the Detailed Description section of disclosure, as discussed in greater detail below.

Figure 1:
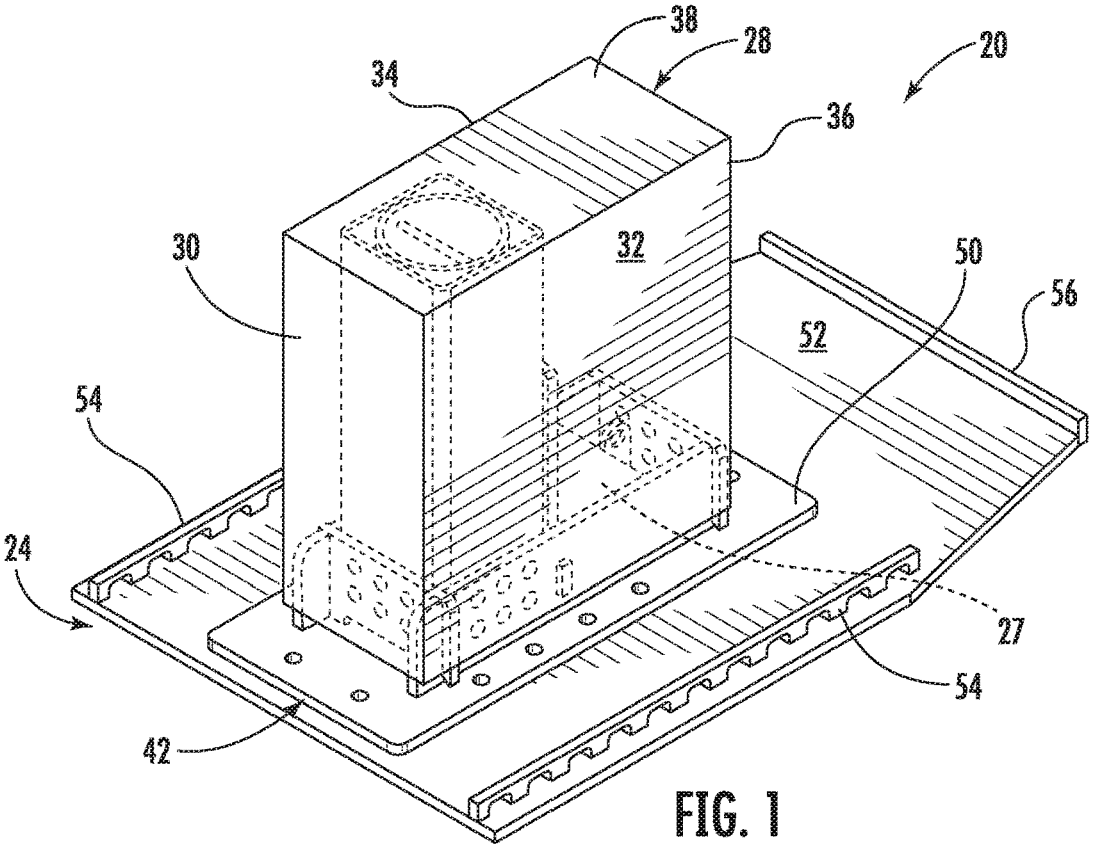
FIG. 1 is a front, top-right, schematic perspective view of a barrier apparatus, wherein the barrier apparatus' substructure is substantially exposed, the barrier apparatus' superstructure is substantially covered by a first version of the barrier apparatus' cover, and some of the hidden portions of the superstructure are schematically depicted by dashed lines, and wherein a front, top-left perspective view of the barrier apparatus is a mirror image of FIG. 1, in accordance with an embodiment of this disclosure.
Figure 2:
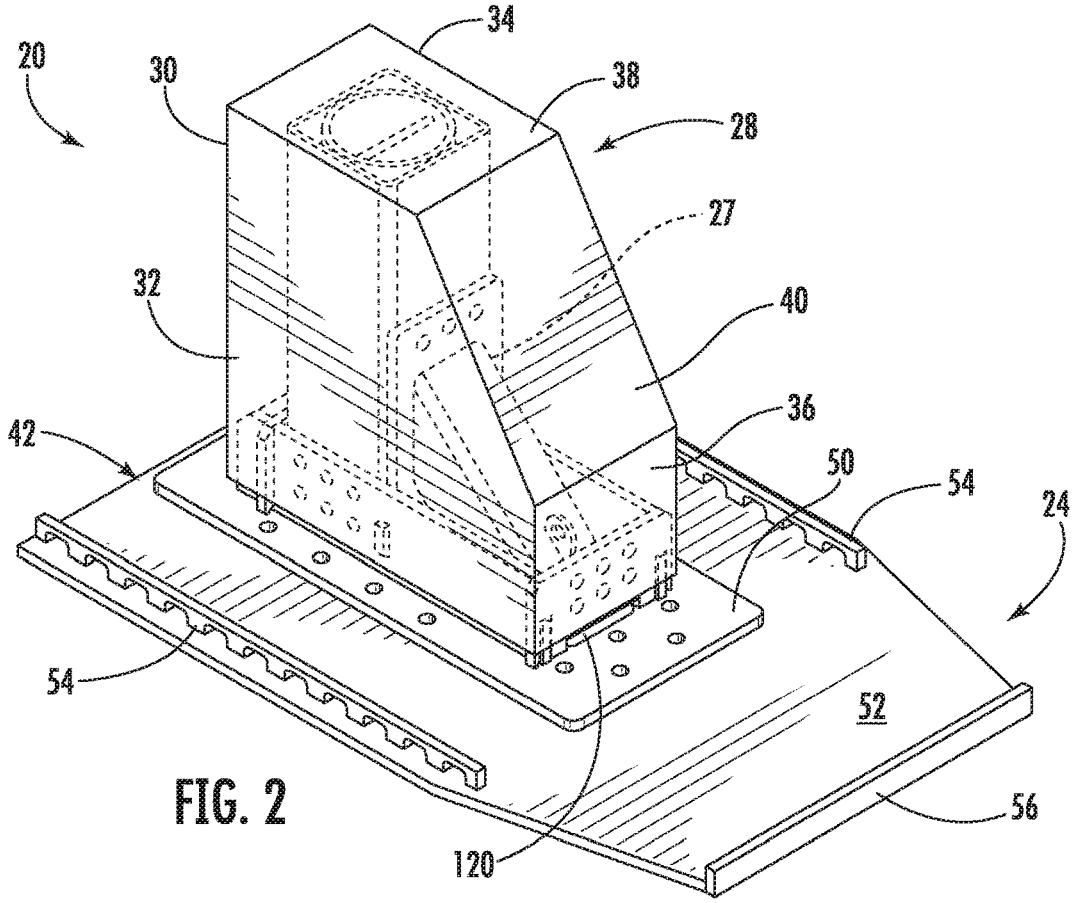
FIG. 2 is a rear, top-right, schematic perspective view of the barrier apparatus of FIG. 1, except for depicting a second version of the barrier apparatus' cover, wherein some of the hidden portions of the superstructure are schematically depicted by dashed lines, and wherein a rear, top-left perspective view of the barrier apparatus of FIG. 2 is a mirror image of FIG. 2, in accordance with an embodiment of this disclosure.

FIGS. 1 and 2 depict that a barrier apparatus 20 of an embodiment of this disclosure includes a superstructure 22 (FIGS. 3, 4, 8 and 9) extending upwardly from a substructure 24 (also see, e.g., FIGS. 6 and 7), and that the superstructure can be at least partially covered by, or at least partially contained in, a barrier cover 28. In FIGS. 1 and 2, portions of the superstructure 22 that are hidden from view within the cover 28 are schematically depicted by dashed lines.

In the embodiment depicted in the drawings ("the depicted embodiment", the superstructure 22 includes a barrier post 26 mounted to and extending upwardly from the substructure 24. In FIGS. 1 and 2 the barrier post 26 is hidden from view within the cover 28 and, thus, schematically depicted by dashed lines. As will be discussed in greater detail below, the substructure 24 can be at least partially embedded in a firm substrate (e.g., concrete foundation) so that the barrier post 26 extends upwardly above the embedding substrate to block vehicles from passing through the area obstructed by the barrier post. In one example of a method of operation of the barrier apparatus 20, the barrier apparatus can be configured to arrest movement of a heavy vehicle (e.g., a truck) that is moving at a high speed and impacts the front of the barrier apparatus 20 (e.g., impacts the front 46 (FIG. 3) of the barrier post 26). The barrier apparatus 20 can also block a variety of different types of vehicles and/or other objects traveling in different directions.

Figure 3:
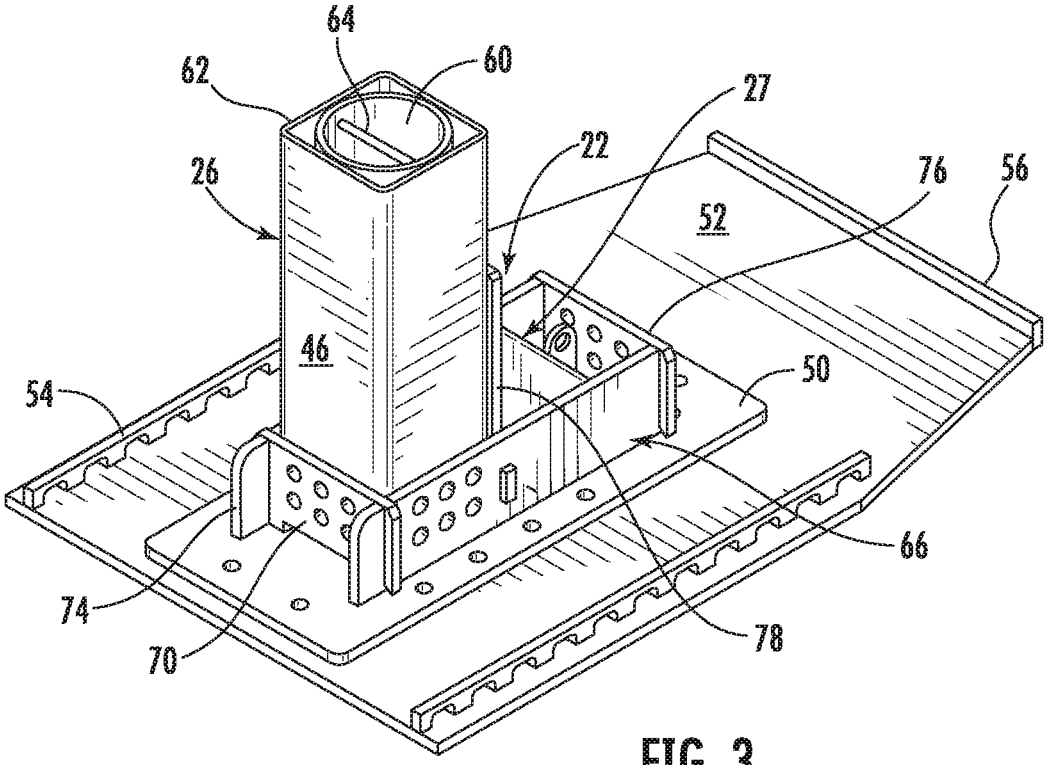
FIG. 3 is a front, top-right perspective view of the barrier apparatus of FIG. 1 without its cover, wherein a front, top-left perspective view of the barrier apparatus of FIG. 3 can be a mirror image of FIG. 3.
Figure 4:
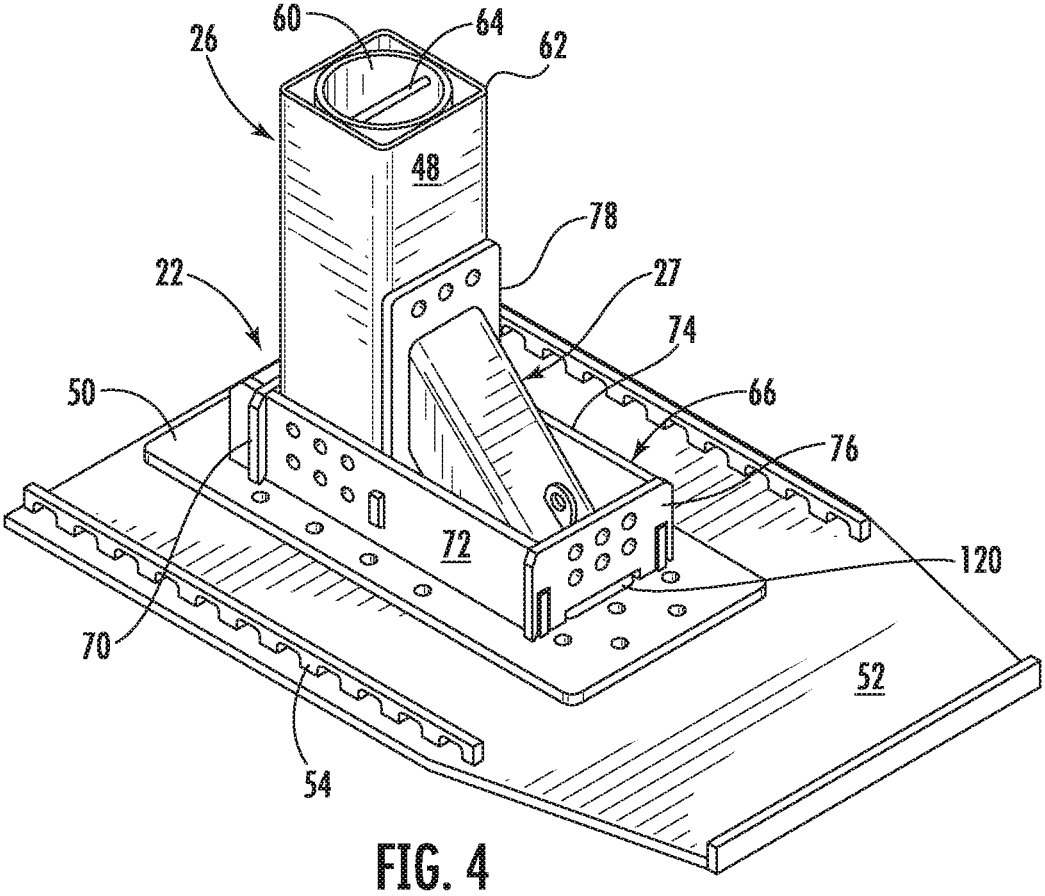
FIG. 4 is a rear, top-right perspective view of the barrier apparatus of FIG. 3, wherein a rear, top-left perspective view of the barrier apparatus of FIG. 4 can be a mirror image of FIG. 4.

In the depicted embodiment, the superstructure 22 further includes one or more braces or at least one bracing system configured to stiffen the barrier apparatus 20 (e.g., at least partially restrict any relative rotation between the barrier post 26 and substructure 24). Referring to FIGS. 3 and 4, such brace(s) and/or bracing system(s) can comprise, for example, a reinforcing brace 27 mounted to, and extending obliquely between, the barrier post 26 and the substructure 24, as will be described further below. In FIGS. 1 and 2 the brace 27 is hidden from view within the cover 28 and, thus, schematically depicted by dashed lines.

FIG. 1 depicts a first version of the barrier apparatus' cover 28, FIG. 2 depicts a second version of the barrier apparatus' cover 28, and other differently configured covers are within the scope of this disclosure. The covers 28 of FIGS. 1 and 2 can be upwardly closed containers that define an interior space and are downwardly open, so that the superstructures 22 can respectively extend through the covers' lower openings and into the covers' interior space. The covers 28 are optional and may be omitted or configured differently.

In the embodiment(s) or versions depicted in FIGS. 1 and 2, the cover 28 has a lower surface or edge(s) defining a lower opening to an interior space of the cover, an interior surface extending around and defining the interior space of the cover, and an outer surface opposite from the interior surface and defining the exterior appearance of the cover. The cover 28 can be made of metallic material, polymeric material, and/or any other suitable material that is typically rigid enough so that the cover can be rigid and self-supporting. The cover 28 is typically opaque for visually concealing at least portions of the barrier 20 that are within the cover's interior space.

More specifically, each cover 28 can include one or more upright (e.g., vertical) panels 30, 32, 34, 36 that extend at least partially around, or more specifically completely around, the interior space of the cover. The at least one upright panel can include a front panel 30, right panel 32, left panel 34, and rear panel 36 that are respectively connected to one another at upright perpendicular corners of the cover 28. A lower edge or lower edges of the one or more upright panels 30, 32, 34, 36 can form the cover's lower surface or edge that extends at least partially around, or more specifically completely around, the lower opening to the interior space of the cover 28.

The upper end of the cover 28 can be closed or at least partially closed by inwardly extending (e.g., curved) portions of the one or more upright panels 30, 32, 34, 36. More specifically and as depicted in the drawings, the upper end of the cover 28 can be closed, or at least partially closed, by at least one cross-wise extending (e.g., horizontal) upper panel 38. In the example of the box-shaped, polygonal or rectangular cover 28 depicted in FIG. 1, peripheral edges of the upper panel 38 are respectively connected to upper edges of the upright panels 30, 32, 34, 36 at perpendicular corners. As an example, the cover's panels 30, 32, 34, 36, 38 can be steel plates that are respectively connected (e.g., welded) to one another, the cover panels 30, 32, 34, 36, 38 can be parts of a cast, molded, or thermoformed cover 28, and/or the cover can be formed in any other suitable manner. The cover 28 can be constructed of metallic material (e.g., steel), polymeric material, and/or any other suitable material(s). The cover 28 may or may not contribute to the overall strength of the barrier apparatus 20.

In the example of the rearwardly inclined cover 28 depicted in FIG. 2, peripheral edges of an inclined panel 40 are respectively connected to each of the rear edges of the upper panel 38, inclined upper edge portions of the right and left panels 32, 34, and an upper edge of the rear panel 36. As an example, the inclined cover's panels 30, 32, 34, 36, 38, 40 can be cover plates that are respectively connected (e.g., welded)to one another, the cover panels 30, 32, 34, 36, 38, 40 can be parts of a cast, molded, or thermoformed cover 28, and/or the cover can be formed in any other suitable manner.

A variety of differently configured covers 28 are within the scope of this disclosure. As further examples, the covers 28 can be configured as domes and variations thereof, upright oblong domes and variations thereof, upright cylinders and variations thereof, obelisks and variations thereof, rocks or boulders, and/or in any other suitable shape that may optionally have decorative or ornamental characteristics.

Typically each of the adjacent components of the barrier apparatus 20 are fixedly connected (e.g., welded) together, except that optionally the cover 28 may be removably mounted to the superstructure 22 and/or substructure 24 by way of interference fit(s), fastener(s), key-operated locking mechanism(s), and/or other suitable features. Alternatively, the cover 28 can be permanently, fixedly mounted (e.g., welded) to the superstructure 22 and/or substructure 24.

FIGS. 3 and 4 depict the barrier 20 without its optional cover 28. In the depicted embodiment, the substructure 24 is in the form of, or includes, a base 42, and the barrier post 26 is mounted to and extends upwardly from the base. As alluded to above and as will be further discussed below, the substructure 24 and/or base 42 can be at least partially embedded in a firm substrate (e.g., concrete foundation) so that the barrier post 26 extends upwardly above the embedding substrate to block vehicles from passing through the area obstructed by the barrier post. The barrier apparatus 20 can be configured to arrest movement of a vehicle that impacts the front 46 of the barrier post 26. As alluded to above and as will be further discussed below, the brace assembly 27 can be mounted to, and extend obliquely between, the rear 48 of the barrier post 26 and the base 42 to stiffen the barrier apparatus 20.

Referring to FIGS. 3 and 4, the base 42 of the substructure 24 can include one or more crosswise extending (e.g., horizontal) plates, for example an upper base plate 50 mounted to the upper surface of a lower base plate 52. The base plates 50, 52 can be connected (e.g., welded) to one another. The substructure 24 can further include upright (e.g., vertical), right and left side flanges 54 formed, for example, at least partially by right and left side plates mounted (e.g., welded) to, and extending upwardly from, right and left portions, edges, or margins of the lower base plate 52. The side flanges 54 can at least partially define or include holes, undulations, and/or other suitable features that at least partially define bar or reinforcement stays, as discussed further below. The substructure 24 can further include an upright (e.g., vertical) rear flange 56 formed, for example, at least partially by a rear plate 56 mounted (e.g., welded) to, and extending upwardly from, a rear portion or rear edge of the lower base plate 52. The rear flange or plate 56 can at least partially function as a "plow" to restrict rearward movement of the barrier apparatus 20, as discussed further below.

Figure 5:
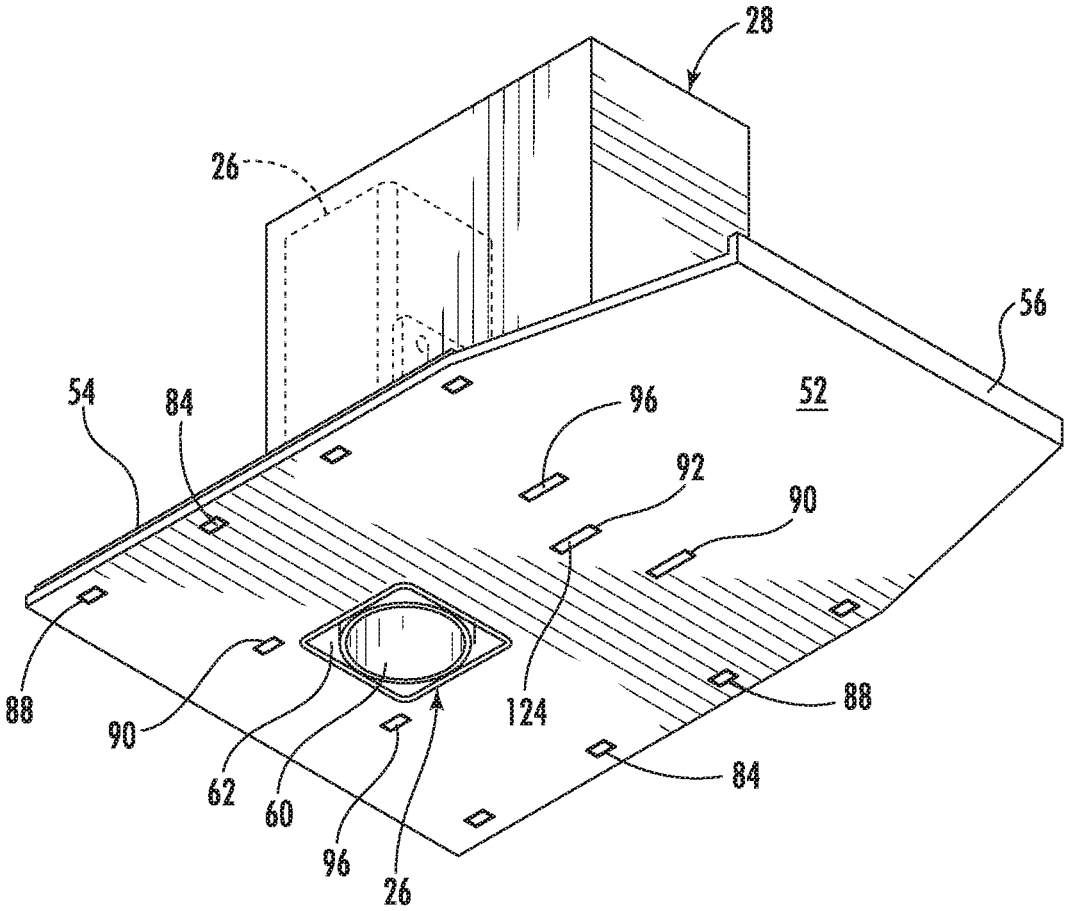
FIG. 5 is rear, bottom-right perspective view of the barrier apparatus of FIG. 1, wherein a rear, bottom-left perspective view of the barrier apparatus of FIG. 5 can be a mirror image of FIG. 5.

Referring to FIGS. 3-5, the superstructure's barrier post 26 can extend into the substructure 24, and can include one or more tubes, for example concentric inner and outer tubes 60, 62 (e.g., hollow structural sections that can be cut pieces of extruded metallic (e.g., steel) structural tubing or pipe). The post's tubes 60, 62 can respectively be circular and polygonal (e.g., rectangular or, more specifically, square) in cross sections taken crosswise to their length. The post's tubes 60, 62 can be fixedly connected to one another by an interference fit and/or other suitable connections (e.g., weld(s)). A crosswise lifting mechanism or pin 64 (FIGS. 3 and 4), for use in lifting the barrier apparatus 20 or barrier post 26, can be fixedly connected to, and span the diameter of, at least one of the post's tubes 60, 62. The post's tubes 60, 62 can be in any other suitable shapes. For example, the post's tubes 60, 62 can respectively be polygonal (e.g., rectangular or, more specifically, square) or circular in cross sections taken crosswise to their length. That is, the outer surface of the barrier post 26 can be round or in any other suitable shape.

With continued reference to FIGS. 3 and 4, and in accordance with the embodiment depicted in the drawings, the superstructure 22 at least partially defines a mount or receptacle that at least partially contains the lower end portion of the barrier post 26. The mount or receptacle for the barrier post 26 can be at least partially defined by a body 66 formed, for example, at least partially by a frame 66.

The frame 66 can include one or more upright (e.g., vertical) plates 70, 72, 74, 76 that extend at least partially around, or more specifically completely around, an interior space of the frame 66 ("frame interior space"). The frame can include a front plate 70, right plate 72, left plate 74, and rear plate 76 that are respectively connected to one another at upright perpendicular corners of the frame 66.

In the depicted embodiment, the frame 66 further includes at least one upright (e.g., vertical) inner plate 78 that is connected to the frame's right and left plates 72, 74, and is distant from the frame's front and rear plates 70, 76. As a result, the inner plate 78 at least partially or completely divides the frame interior space into: a forward interior space, mount, or receptacle; and a rearward interior space, mount, or receptacle of frame interior space. In the depicted embodiment, the forward interior space, mount, or receptacle portion of the frame interior space at least partially contains a lower end portion of the barrier post 26; and the rearward interior space, mount, or receptacle portion of the frame interior space at least partially contains the brace 27.

The plates 70, 72, 74, 76, 78 of the frame 66 can be respectively connected (e.g., welded) to one another. Similarly, the post 26 can be connected (e.g., welded) to the one or more of the plates 70, 72, 74, 78, and the brace 27 can be connected (e.g., welded) to the one or more of the plates 72, 74, 76, 78. The frame 66 can be configured differently by, for example, omitting or reconfiguration of one or more of the plates 70, 72, 74, 76, 78.

In at least some configurations, it is believed to be unnecessary for the respective panels or plates of the barrier apparatus 20 to extend exactly vertically, horizontally, and perpendicularly. More generally and for example, the frame 66 can include plates extending transversely or crosswise to one another (e.g., neither exactly perpendicular nor meeting at exactly right angles).

Figure 6:
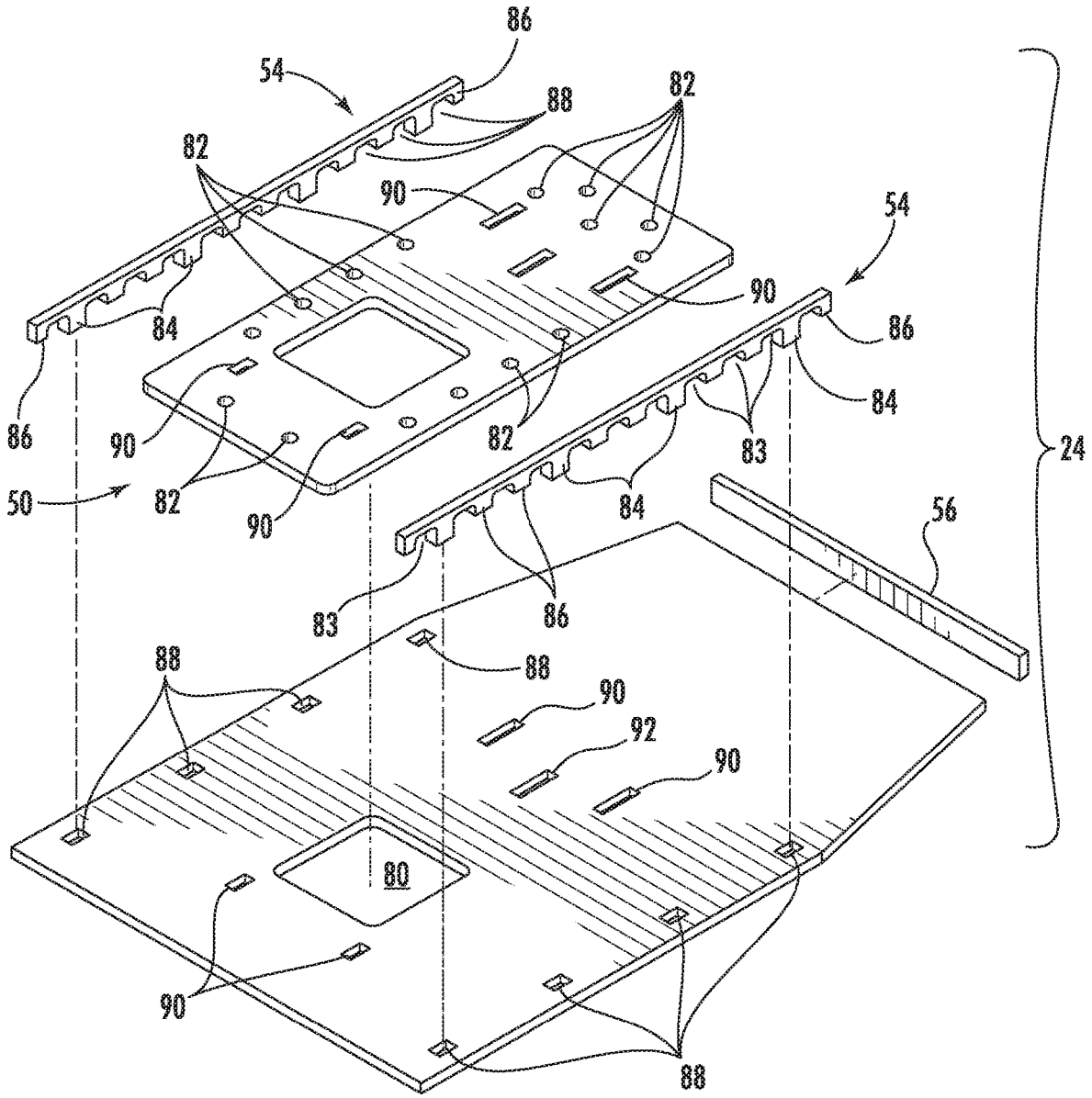
FIG. 6 is an isolated, front, top-right exploded perspective view of the substructure of FIG. 1, wherein a front, top-left perspective view of the configuration of FIG. 6 can be a mirror image of FIG. 6.
Figure 7:
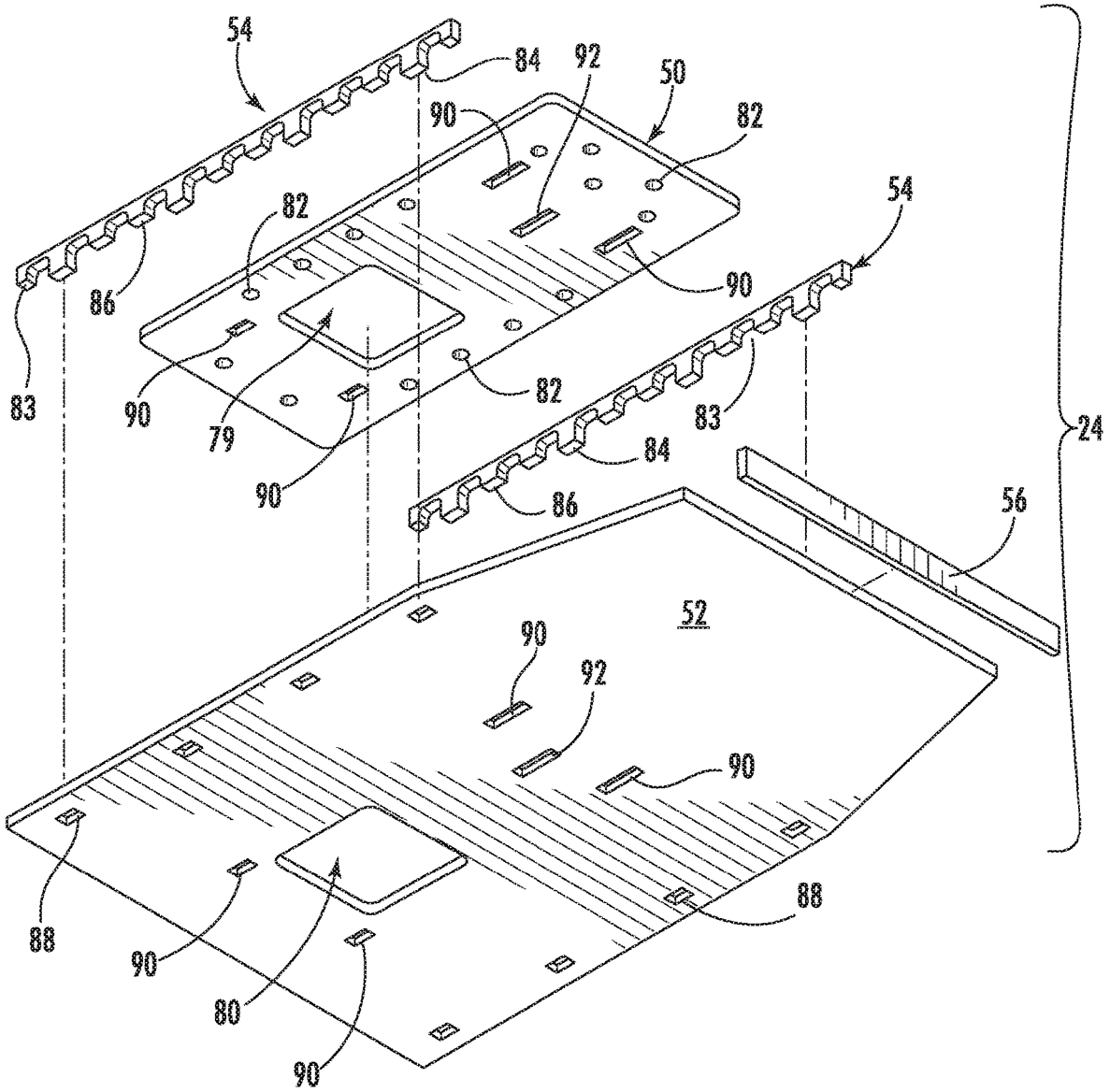
FIG. 7 is a rear, bottom-right view of the configuration of FIG. 6, wherein a rear, bottom-left perspective view of the configuration of FIG. 7 can be a mirror image of FIG. 7.

FIGS. 6 and 7 are isolated, exploded views of the substructure 24. In the depicted embodiment, the base plates 50, 52 respectively include centrally-located, polygonal, or rectangular (e.g. square) post-receiving holes 79, 80; and the post-receiving holes 79, 80 are configured and the base plates 50, 52 are connected to one another so that the post-receiving holes 79, 80 are superposed, coaxial, and concentric with respect to one another. The post-receiving holes 79, 80 can be configured so that they substantially match (e.g., are slightly larger than) the profile of the outer surface of the post's outer tube 62 (FIGS. 3-5). The post 26 (FIGS. 3-5) can extend downwardly through the post-receiving hole 79 of the upper base plate 50, and at least downwardly into the post-receiving hole 80 of the lower base plate 52. The post 26 can be welded to the base plates 50, 52 in the vicinity of the post-receiving holes 79, 80.

One or more additional holes 82 can extend through one or more of the base plates 50, 52, wherein these holes 82 can be configured as weld access holes 82 for receiving welding material, so that base plate holes 82 at least partially facilitate the welding together of the base plates 50, 52. In the example depicted in FIGS. 6 and 7, the weld access holes 82 extend through the upper base plate 50.

The base plates 50, 52 can be in opposing face-to-face relation and/or contact with one another. At least one of, or each of the upright flanges, side plates, or reinforcement stays 54 can include one or more reinforcement-receiving holes 83 extending therethrough, as discussed further below.

As an example, the parts of the superstructure 22 and substructure 24 can be made of metallic material (e.g., steel) and be respectively welded to one another in a manner that seeks to restrict them from being forced apart from one another, for example when the barrier post 26 is impacted by a vehicle. Also, respective parts of the superstructure 22 and substructure 24 can include mating parts for being respectively mated with other mating parts to form mated joints. The mating parts can fit and interlock together for increased strength in a manner that seeks to restrict them from being forced apart from one another, for example when the barrier post 26 is impacted by a vehicle. For at least some of, at least a majority of, or each of the mated joints of the barrier apparatus 10, the mated together parts of the mated joint can be welded together in a manner that restricts the mated parts from being forced apart from one another, for example when the barrier post 26 is impacted by a vehicle.

In the example depicted in FIGS. 6 and 7, at least some of the parts of the substructure 24 include one or more male-like mating parts and/or one or more relatively female-like mating parts for being respectively mated with other mating parts to form mated joints. As a more specific example, the side flanges 54 can include male-like mating parts or portions in the form of polygonal or rectangular protrusions 84. In the example depicted in FIGS. 6 and 7, the mating protrusions 84 are positioned between, and partially define, pairs of the reinforcement-receiving holes 83. The side flanges 54 can further include relatively shorter protrusions 86 (e.g., engagement protrusions 86) for engaging the upper surface of the upper base plate 50. In the example depicted in FIGS. 6 and 7, the engagement protrusions 86 are positioned between, and partially define, pairs of the reinforcement-receiving holes 83.

One or more relatively female-like mating parts of the base plates 50, 52 can include cavities in the form of holes or more specifically polygonal or rectangular mating slots 88, 90, 92 that are circumscribed by respective portions of the base plates. The reinforcement stays' protrusions 84 respectively fit into (e.g., fit snugly into) the lower base plate's mating slots 88. The mating slots 90, 92 can be configured and the base plates 50, 52 can be connected to one another so that the upper base plate's mating slots 90, 92 are respectively superposed, coaxial, and concentric with the lower base plate's mating slots 90, 92.

Figure 8:
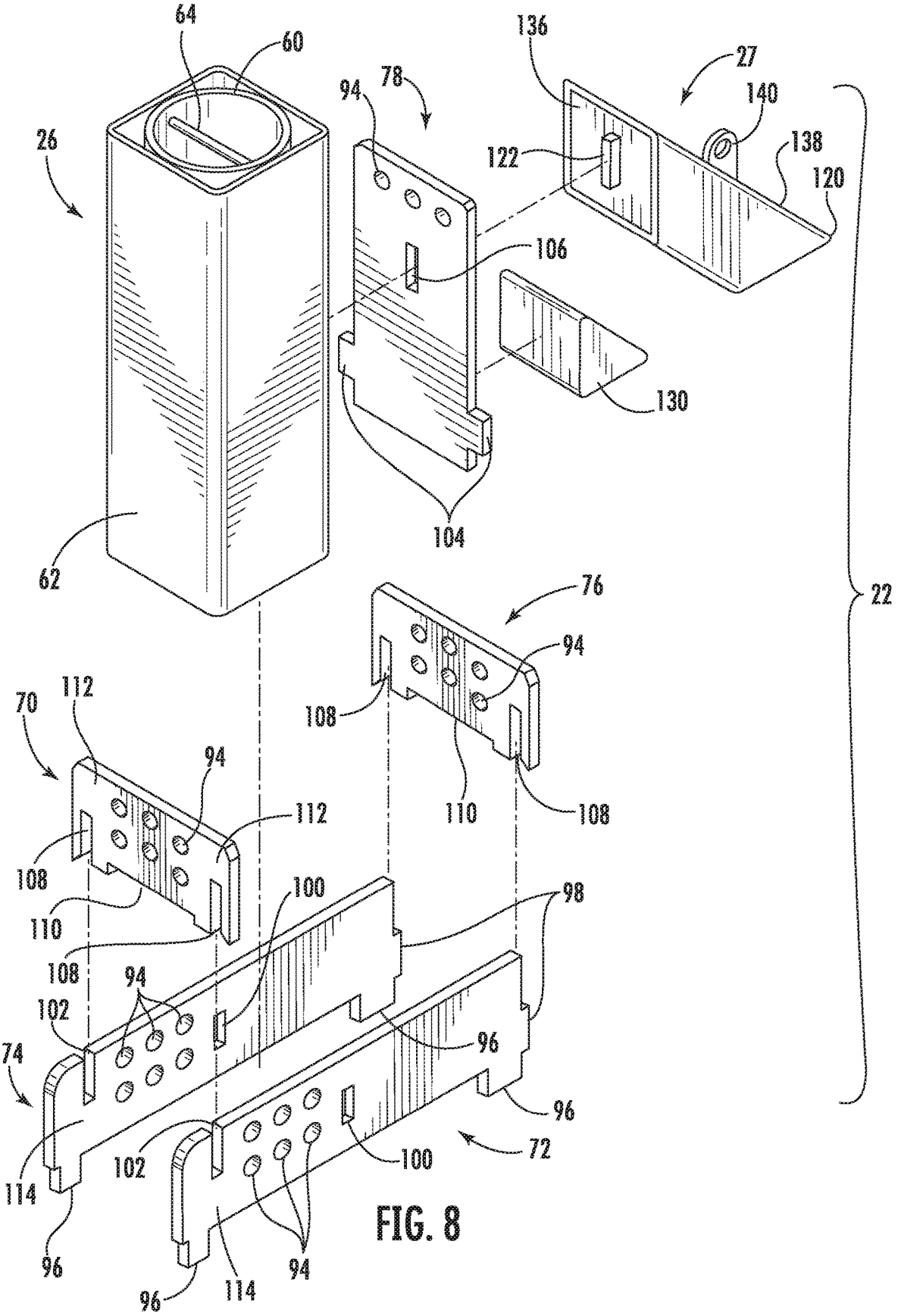
FIG. 8 is an isolated, front, top-right, partially exploded perspective view of the superstructure of the FIG. 1, wherein a front, top-left perspective view of the configuration of FIG. 8 can be a mirror image of FIG. 8.
Figure 9:
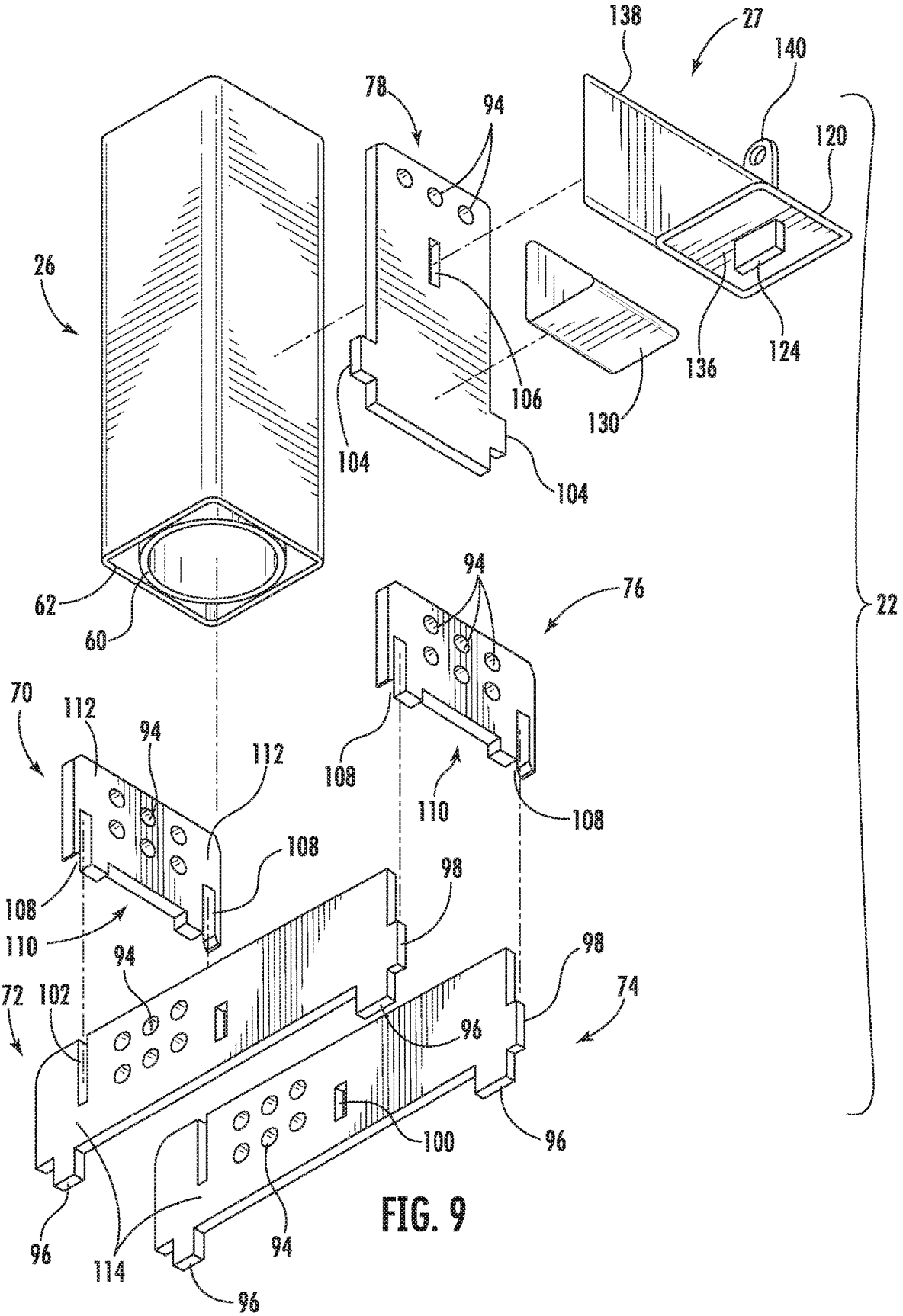
FIG. 9 is a rear, bottom-right view of the configuration of FIG. 8, wherein a rear, bottom-left perspective view of the configuration of FIG. 9 can be a mirror image of FIG. 9.

In the example depicted in FIGS. 8 and 9, the frame's front and rear plates 70, 76 are identical to one another, and the frame's right and left plates 72, 74 are identical to one another. Such identicality is optional. One or more holes 94 can extend through one or more of the frame's plates 70, 72, 74, 76, 78. The plates' holes 94 can be configured as weld access holes 94 for receiving welding material, so that the weld access holes 94 of the frame's plates 70, 72, 74, 78 at least partially facilitate welding frame's plates 70, 72, 74, 78 to the post's outer tube 62. The frame's plates 70, 72, 74, 78 can be in opposing face-to-face relation and/or contact with the respective outer sides or faces of the post's outer tube 62.

Referring to FIGS. 8 and 9, the frame's right and left plates 72, 74 can include one or more relatively male-like mating parts or portions in the form of polygonal or rectangular protrusions 96 that extend outwardly from respective edges and are configured to respectively fit into (e.g., fit snugly into) the base plate's mating slots 90 (FIGS. 6 and 7). For each protrusion 96 and the associated mating slots 90, the mating protrusion 96 can extend downwardly through the mating slot 90 of the upper base plate 50, and at least downwardly into the mating slot 90 of the lower base plate 52. That is, the mating protrusions 96 can be relatively longer as compared to other protrusions since they fit into both of the base plates 50, 52.

The frame's right and left plates 72, 74 can further include one or more relatively male-like mating parts or portions in the form of polygonal or rectangular protrusions 98 that extend outwardly from respective edges. One or more relatively female-like mating parts of the frame's right and left plates 72, 74 can include cavities in the form of holes or more specifically polygonal or rectangular mating slots 100, 102. The depicted mating slots 100 are circumscribed by respective portions of the right and left plates 72, 74. The depicted mating slots 102 are open at respective portions of the right and left plates 72, 74.

The frame's inner plate 78 can include one or more relatively male-like mating parts or portions in the form of polygonal or rectangular protrusions 104 that extend outwardly from respective edges and are configured to respectively fit into (e.g., fit snugly into) the right and left plates' mating slots 100. At least one female mating part of the frame's inner plate 78 can include a cavity in the form of a hole or more specifically a polygonal or rectangular mating slot 106 that is circumscribed by respective portions of the frame's inner plate.

The frame's front and rear plates 70, 76 can include one or more relatively female-like mating parts or portions in the form of cavities or holes that can be more specifically in the form of polygonal or rectangular mating slots 108, 110 that are open at respective edges of the frame's front and rear plates. The right and left plates' rear protrusions 98 can be configured to respectively fit into (e.g., fit snugly into) the rear plate's mating slots 108. The right and left plates' forward mating slots 102 can be configured to respectively receive (e.g., snugly receive) portions 112 of the front plate 70 that are adjacent to and partially define the front plate's mating slots 108. Similarly, the front plate's mating slots 108 can be configured to respectively receive (e.g., snugly receive) portions 114 of the right and left plates 72, 74 that are adjacent to and partially define the mating slots 102.

With continued reference to FIGS. 8 and 9, the angle brace 27 can include one or more relatively male-like mating parts or portions in the form of a triangular rear edge protrusion or portion 120, and polygonal or rectangular protrusions 122, 124 respectively extending outwardly from front and bottom surfaces of the angle brace. The angle brace's rear edge portion 120 can be configured to fit into (e.g., fit snugly into) the rear plate's lower mating slot 110. The angle brace's at least one front protrusion 122 can be configured to fit into (e.g., fit snugly into) the central mating slot 106 of the frame's inner plate 78. The outer or front end of the front protrusion 122 can be in opposing face-to-face relation (e.g., contact) with the barrier post's rear surface (FIG. 4).

The angle brace's at least one bottom protrusion 124 can be configured to fit into (e.g., fit snugly into) the base plates' central mating slots 92 (FIGS. 6 and 7). The angle brace's bottom protrusion 124 can extend downwardly through the mating slot 92 of the upper base plate 50, and at least downwardly into the mating slot 92 of the lower base plate 52. That is, the brace's bottom protrusion 124 can be relatively longer as compared to other protrusions (e.g., the brace's front protrusion 122) since the bottom protrusion 124 fits into both base plates 50, 52.

In the embodiment depicted in FIGS. 8 and 9, the angle brace 27 can be part of a brace system that further includes a corner brace 130, and optionally the brace system may be characterized as including one or more other components of the superstructure 22 and/or substructure 24 (e.g., component(s) connected to the angle brace 27 and/or corner brace 130). In the depicted embodiment, the corner brace 130 is a triangular block (e.g., a solid block of material) that fits into a rear corner positioned between the barrier post 26 and base 42 (e.g., upper base plate 50) so that the corner brace's front surface is in opposing face-to-face relation (e.g., contact) with the rear surface of the frame's inner plate 78, the corner brace's bottom surface is in opposing face-to-face relation (e.g., contact) with the upper surface of the base 42 (e.g., upper base plate 50), and the corner brace's inclined (e.g., hypotenuse) surface is in opposing face-to-face relation (e.g., contact) with the lower inclined surface of the angle brace 27. In the depicted embodiment, the triangular shape of the corner brace 130 can be seen in isolated right and left elevation views of the corner brace.

The corner brace 130 can be connected (e.g., welded) to one or more of the base 42 (e.g., upper base plate 50); the frame's right, left, and inner plates 72, 74, 78; and the angle brace 27. The corner brace 130 can be constructed of metallic material (e.g., steel), and it can be cast, forged, machined, cut from an extrusion, and/or be formed in any other suitable manner.

Figure 10:
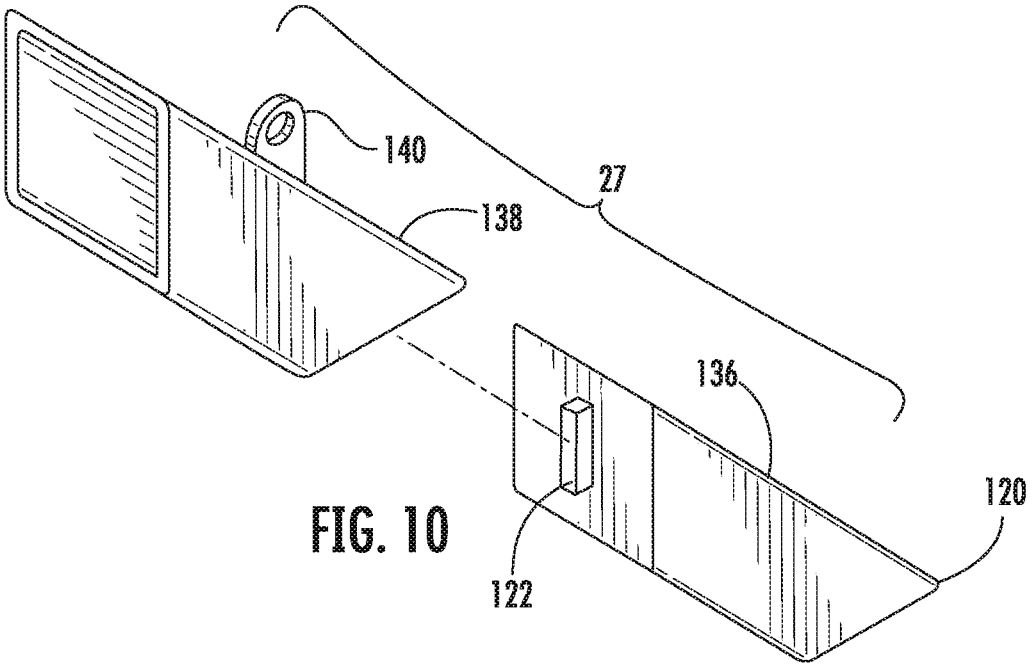
FIG. 10 is an isolated, front-right, partially exploded perspective view of an angle brace assembly of the superstructure of FIG. 8, wherein a front-left perspective view of the configuration of FIG. 10 can be a mirror image of FIG. 10.

Referring primarily to FIG. 10 and also to FIGS. 8 and 9, the angle brace 27 can include a trapezoidal (e.g., acute or isosceles trapezoidal) inner brace block 136, and optionally also a structural reinforcement 138 extending at least partially around the inner brace block. More specifically, the inner brace block 136 (e.g., solid block of material) can extend within a tubular, trapezoidal (e.g., acute or isosceles trapezoidal) outer brace tube 138 (e.g., a structural reinforcing tube, steel pipe, or the like). In the depicted embodiment, the trapezoidal shapes of the inner brace block 136 and outer brace tube 138 can be seen in isolated right and left elevation views of these components. In the depicted embodiment, the inner brace block 136 and outer brace tube 138 are polygonal or rectangular (e.g., square) in cross sections taken crosswise to their length. The inner brace block 136 and outer brace tube 138 can be in any other suitable shapes. For example, the inner brace block 136 and outer brace tube 138 can be circular in cross sections taken crosswise to their lengths.

The inner brace block 136 and outer brace tube 138 can be mated together so that an annular, elongate interior surface of the outer brace tube 138 can conform to an annular, elongate outer surface of the inner brace block 136, so that there can be an interference fit and/or welded connection between these surfaces. The angle brace's brace block 136 can be constructed of metallic material (e.g., steel), and it can be cast, forged, machined, cut from an extrusion, and/or be formed in any other suitable manner. The angle brace's brace tube 138 can be a hollow structural section cut from extruded metallic (e.g., steel) structural tubing (e.g. pipe).

The angle brace's brace block 136 and brace tube 138 can have different structural characteristics in a manner that provides synergistic results with regard to the functionality of the angle brace 27. As one specific example, it is believed that the angle brace's brace block 136 can be at least partially formed by casting and/or forging, and the angle brace's brace tube 138 can be at least partially formed by extruding, so that the brace block 136 and brace tube 138 have different structural characteristics in a manner that at least partially provides the synergistic results. The angle brace's brace block 136 and brace tube 138 can be connected (e.g., welded) to one another and to adjacent components of the barrier apparatus 20. The angle brace's protrusions 122, 124 can extend outwardly from the front and bottom surfaces of the brace block 136. A lifting mechanism or eyelet lug 140 for use in lifting the barrier apparatus 20 can be fixedly connected (e.g., welded) to the upper inclined surface of the angle brace 27 or in any other suitable location. In the depicted embodiment, the bracing blocks 130, 136 are thicker than the plates of this disclosure, for example at least about twice as thick, at least about three times as thick, or any other suitable thickness.

The brace system, angle brace 27, and/or corner brace 130 can be configured differently, and at least one of (e.g., one or the other of) the braces 27, 130 can be omitted. In one example, the corner brace 130 may be omitted without changing the angle brace 27. As another example, when the corner brace 130 is be omitted, the angle brace 27 can be replaced with, or be in the form of, a triangular block, wherein the mating protrusions 122, 124 can respectively extend outwardly from front and bottom surfaces of the triangular block. Alternatively, the triangular block with the mating protrusions 122, 124 can be replaced with a rectangular block, wherein the mating protrusions 122, 124 can respectively extend outwardly from front and bottom surfaces of the triangular block. As a further example, the corner brace 130 can be larger than depicted in the drawings, and the mating protrusions 122, 124 can respectively extend outwardly from front and bottom surfaces of the corner brace. Other variations are within the scope of this disclosure. For example, in the foregoing it has been mentioned that one or more of the mating protrusions and mating slots may be polygonal or rectangular; however, differently shaped mating protrusions and mating slots are within the scope of this disclosure. For example, one or more of the mating protrusions and mating slots or holes can be round, triangular, or any other suitable shape. Optionally, one or more of the mating protrusions and mating slots or holes can be omitted from the barrier apparatus 20 and/or additional mating protrusions and mating slots or holes can be included in the barrier apparatus.

Figure 11:
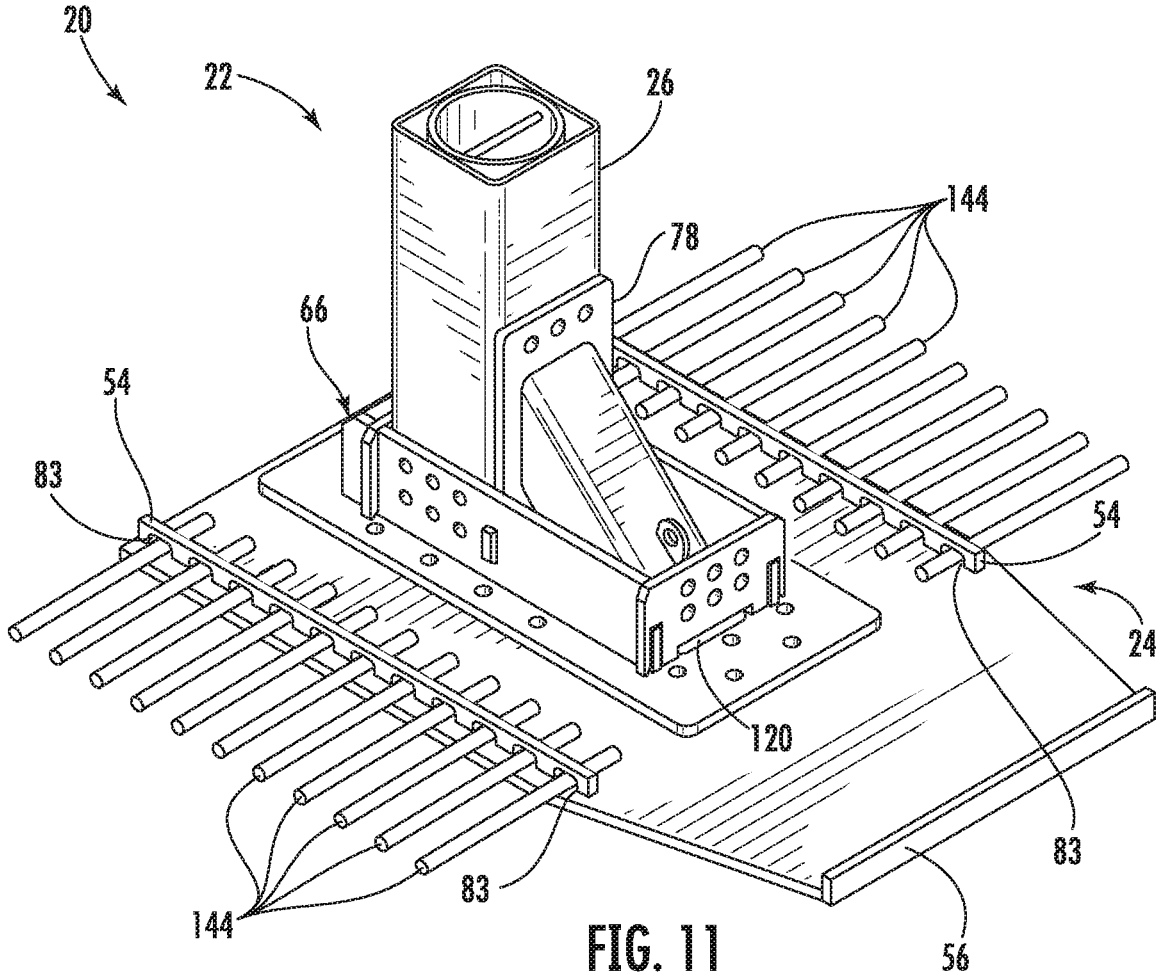
FIG. 11 is a rear, top-right perspective view of the barrier apparatus of FIG. 4 further including reinforcing bars, wherein a rear, top-left perspective view of the barrier apparatus of FIG. 11 can be a mirror image of FIG. 11, in accordance with an embodiment of this disclosure.
Figure 13:
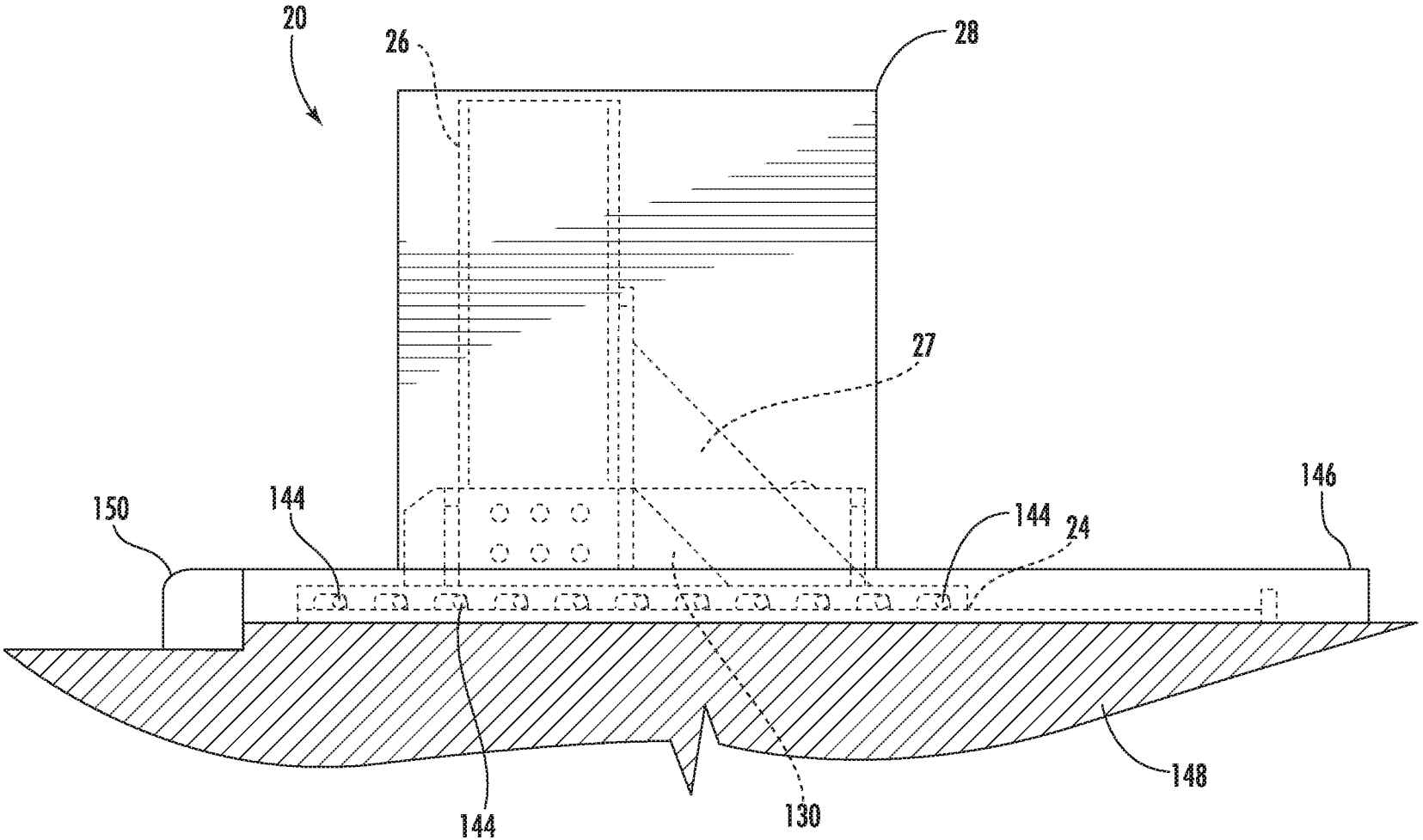
FIG. 13 is a schematic, right elevation view of the system of FIG. 12 and further including cover(s), wherein a left elevation view of the system of FIG. 13 can be a mirror image of FIG. 13, in accordance with an embodiment of this disclosure.
Figure 14:
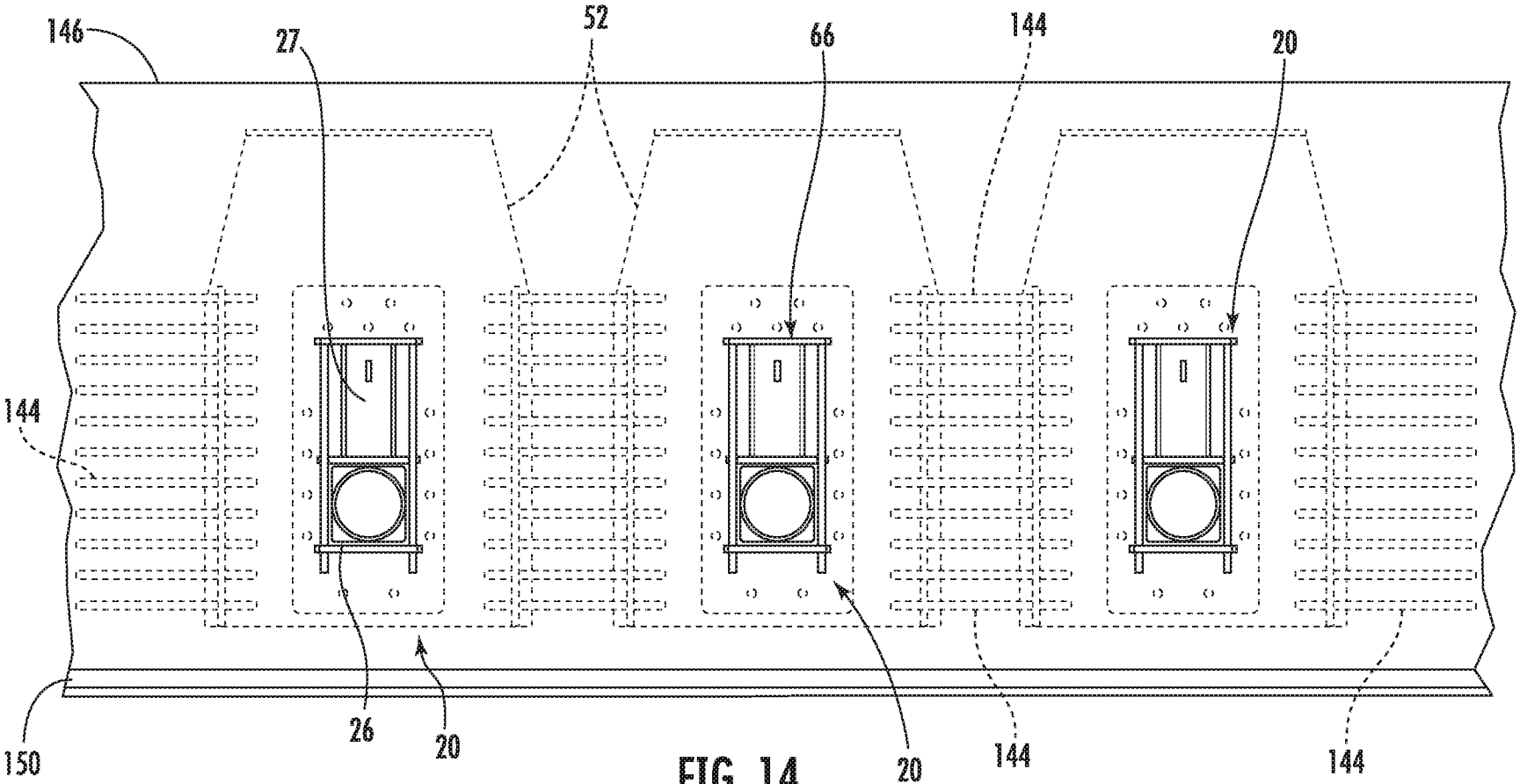
FIG. 14 is a top plan view of a portion of the system of FIG. 12.
Figure 15:
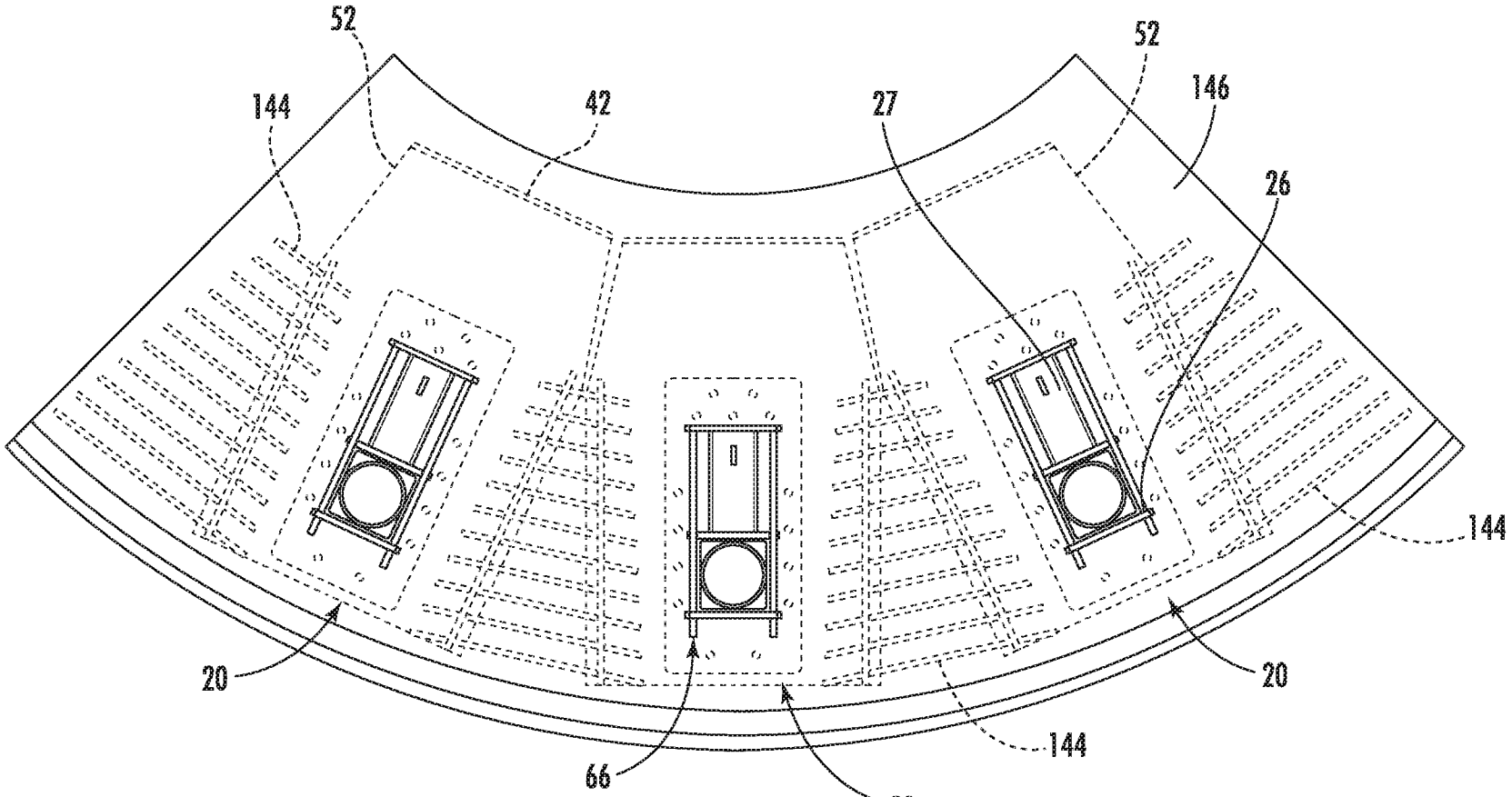
FIG. 15 is like FIG. 14 except, for example, the system of FIG. 15 is in a curved configuration, in accordance with an embodiment of this disclosure.

FIGS. 1-4 depict the barrier apparatus 20 in an assembled or partially assembled state in which it may be transported to an installation site, although the barrier apparatuses may be transported in a variety of different partially assembled states. Referring to FIG. 11, reinforcing bars 144 can be mounted to the barrier apparatus 20 before it is partially embedded in the substrate 146 (FIGS. 13-15). FIG. 11 depicts an example of the barrier apparatus 20 after reinforcing rods or bars 144 (e.g., rebar) have been mounted (e.g., welded) to the base 42 or substructure 24, wherein each piece of rebar 144 extends crosswise to the lengthwise axis of the base 42 or substructure 24, and each piece of rebar 144 extends through (e.g., is inserted through) at least one respective reinforcement-receiving hole 83.

Figure 12:
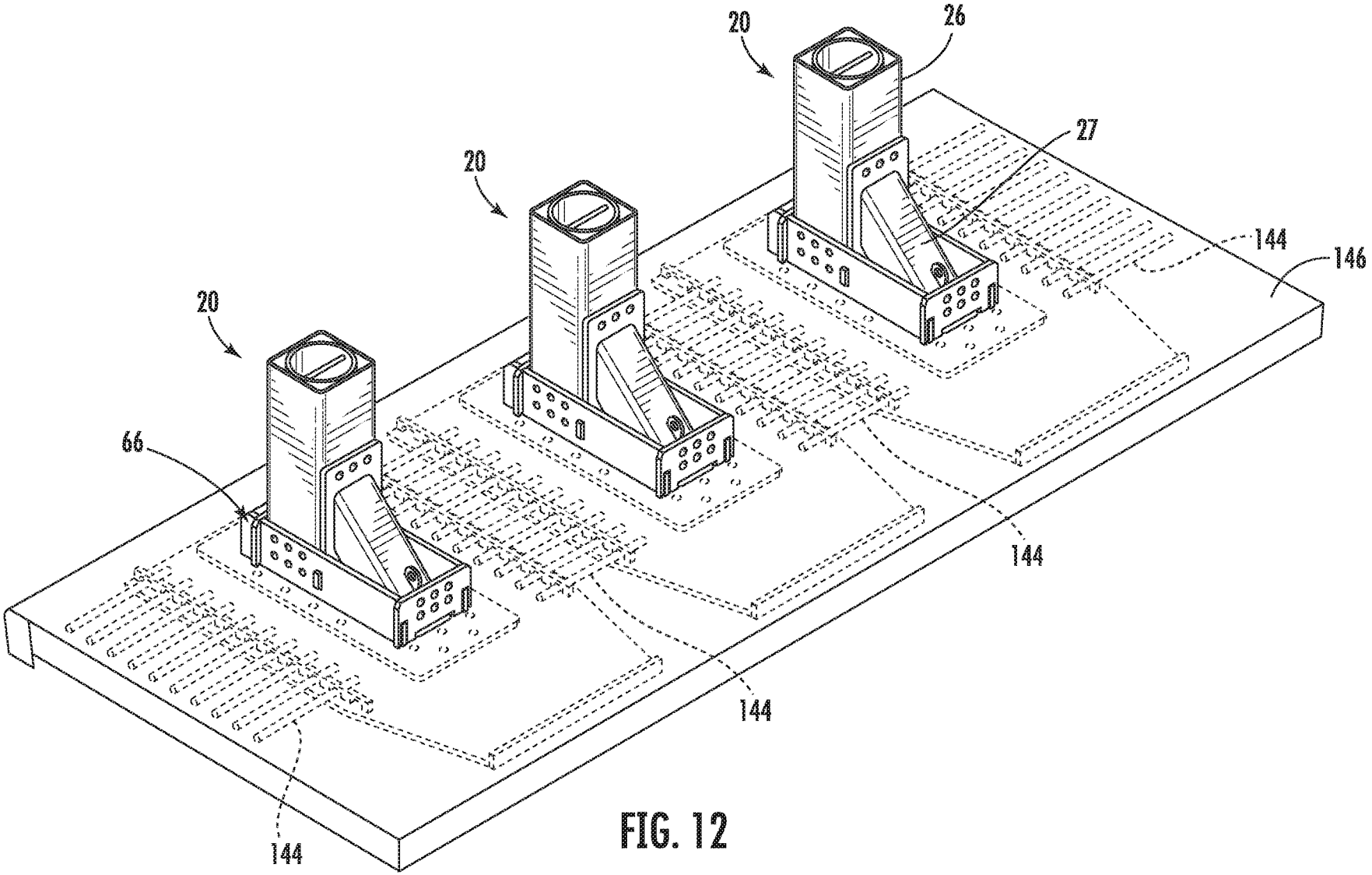
FIG. 12 is a rear, top-right, schematic perspective view of a series of the barrier assemblies of FIG. 11 arranged in a straight row, wherein the substructures of the barrier assemblies are embedded in a foundation, wherein a rear, top-left perspective view of the system of FIG. 12 can be a mirror image of FIG. 12, in accordance with an embodiment of this disclosure.

FIGS. 12 and 13 schematically depict an example of a series of the barrier apparatuses 20 including rebar 144 embedded in at least one substrate 146 supported by a subgrade 148 (FIG. 13). The substrate 146 can be in the form of a concrete slab 146 (e.g., high-strength, 4,000 psi concrete), and optionally a reveal layer (not shown) may be on top of the main concrete slab. Any reveal layer may be a continuation of the concrete slab 146, may be an architectural concrete that has a relatively superior surface finish, may include paving blocks, and/or may be any other suitable upper portion of the substrate 146. A concrete or other suitable curb 150 can be adjacent the front edge of the substrate 146 (e.g., concrete slab).

In accordance with an example of a method of installing a barrier apparatus 20, after the subgrade 148 (e.g., gravel, fill dirt, and or other suitable subgrade material) is compacted and/or otherwise configured in a predetermined manner, the bottom of the substructure 24 can be placed directly upon the subgrade 148. In the example depicted in FIG. 13, the substructure 24 is securely at least partially embedded and anchored in the substrate 146 (e.g., concrete), and the horizontal rebar 144 is embedded in and reinforces the substrate. Additionally, vertical pieces of rebar or other suitable reinforcements can be placed in the interior of the barrier post's inner tube 60 and in the interior corner areas of the barrier posts' outer tube 62, and the interiors of the barrier post's tubes 60, 62 can be at least partially filled with the substrate material (e.g., concrete). In the example depicted in FIG. 13, at least an upper portion of each of the braces 27, 130 extends to an elevation above the upper surface of the substrate 146 (e.g., concrete), and at least a lower portion of each of the braces 27, 130 extends to an elevation below the upper surface of the substrate 146 (e.g., concrete).

The base 42, or more specifically the lower base plate 52, can have a relatively large lower surface area configured to distribute the forces applied against the substrate 146 over a relatively large area of the substrate when the barrier post 26 is struct by a vehicle or other object, so that the force per unit area that is applied against the substrate is relatively small (e.g., the load applied is spread over a relatively large area). In this regard, it is believed that the relatively large lower surface area of the base 42 can allow the barrier apparatus 20 to be used on a variety of differently configured substrates 146, for example relatively thin substrates positioned above, comprising, consisting essentially of, or consisting of containments for underground utilities, tunnels (e.g., tunnel roof structures), basements (e.g., basement roof structures), subways (e.g., subway roof structures), parking decks, and/or other suitable substrates, or the like. For example, the base 42, or more specifically the lower base plate 52, can have a lower surface area of twenty-six square feet, a length of seven feet, and a width of four feet, wherein it is believed that these values can vary within a range of plus and/or minus five percent, within a range of plus and/or minus ten percent, within a range of plus and/or minus fifteen percent, within a range of plus and/or minus twenty percent, within a range of plus and/or minus twenty-five percent, and/or any values or subranges therebetween. For example, the base 42, or more specifically the lower base plate 52, can have a lower surface area of greater than five square feet, greater than seven square feet, greater than nine square feet, greater than eleven square feet, greater than thirteen square feet, greater than fifteen square feet, greater than seventeen square feet, greater than nineteen square feet, greater than twenty-one square feet, greater than twenty-three square feet, or greater than twenty-five square feet, and/or any values or subranges therebetween.

Alternatively, additionally, and/or optionally, masonry blocks or other suitable supports (not shown) can be placed upon the subgrade 148 in a predetermined manner, and the bottom of the substructure 24 can be placed upon the supports in a predetermined manner (e.g., so that, when supplied, the uncured flowing substrate can flow beneath, around, and over the substructure 24).

In the examples of FIGS. 12, 14, and 15, the barrier apparatuses 20 are assembled as barrier systems, wherein between adjacent barrier apparatus 20, the depicted pieces of rebar 144 extend through reinforcement-receiving holes 83 of both barrier apparatuses. In FIGS. 12, 14, and 15, the vertical centerlines of adjacent barrier posts 26 can be about sixty inches apart, wherein it is believed that this values can vary within a range of plus and/or minus five percent, within a range of plus and/or minus ten percent, within a range of plus and/or minus fifteen percent, within a range of plus and/or minus twenty percent, within a range of plus and/or minus twenty-five percent, and/or any values or subranges therebetween. As depicted in FIG. 15, rearward side edges of the bases 42, or more particularly the lower base plates 52, can be tapered to facilitate the curved arrangement of the series of barrier apparatuses 20. As an example and not for the purpose of limiting the scope of this disclosure, the tapered rearward side edges of the bases 42 (e.g., lower base plates 52) and relatively large sizes of the reinforcement-receiving holes 83 can advantageously allow a standardized barrier apparatus 20 to be used in either a curved or straight series of such barrier apparatuses.

Whereas in the depicted embodiment the reinforcement-receiving holes 83 are somewhat or generally circular for receiving reinforcements 144 in the form of rebar, or the like, the reinforcement-receiving holes 83 and/or the reinforcements 144 can configured differently. For example, at least some of or each of the reinforcements 144 can be in the form of plates (e.g., elongate strip-like plates, or the like), and the reinforcement-receiving holes 83 can be configured for respectively receiving such reinforcing plates, or the like.

As an example, it is believed that in some situations the barrier apparatus 20 may be configured as, and used as, a stand-alone security barrier, for example a single stand-alone security barrier configured for stopping a heavy vehicle traveling at high speed. In stand-alone and system configurations, for enhancing performance of a barrier apparatus 20 when the vehicle impacts the front 25 of the barrier post 26, the brace system (e.g., angle and corner braces 27, 130) can stiffen the barrier apparatus 20 (e.g., at least partially restrict any relative rotation between the barrier post 26 and substructure 24). As another example, the substructure's rear flange or plate 56 increases the surface area of the substructure 24 that is bearing against the substrate positioned rearwardly of the substructure 24 in a manner that provides or enhances a plowing affect during a vehicle impact.

Reiterating from above, the barrier apparatus 20 depicted in the drawings is configured to be capable of being used as a shallow-mount security barrier. For example, the base 42 (e.g., stacked base plates 50, 52) can have a vertical height or thickness of about two inches, the substrate 146 can have a vertical height or thickness of about four inches, the barrier post 26 can have a vertical height or length of about thirty-nine inches, and the cover 28 can have a vertical height or length of about thirty-five inches, wherein it is believed that each of these values can vary within a range of plus and/or minus five percent, within a range of plus and/or minus ten percent, within a range of plus and/or minus fifteen percent, within a range of plus and/or minus twenty percent, within a range of plus and/or minus twenty-five percent, and/or any values or subranges therebetween. The barrier post 26 typically has a vertical height or length of less than fifty inches, less than forty-eight inches, less than forty-three inches, or less than about forty inches. The lower edge of the cover 28 can be about flush with the upper surface of the embedding substrate 146. Typically the upper end of the barrier post 26 is not load bearing and does not engage the inner surface of the cover 28. On the other hand, the upper end of the barrier post may be minimally load bearing as a result of the upper end of the barrier post engaging and at least partially supporting the cover 28.

Variations are within the scope of this disclosure. For example, in addition to and/or as an alternative to the above-discussed connections between respective components of the barrier apparatus 20, the barrier apparatus can include other suitable connections. For example, respective portions of the barrier apparatus 20 and be fixedly or removably connected by suitable fasteners such as threaded bolts, threaded nuts, brackets, and/or other suitable devices. As one specific example, the barrier post 26, frame's inner plate 78, and braces 27, 130 can be fixedly connected to one another and removably mounted to the remainder of the barrier apparatus 20 by way of bolts and/or other suitable fasteners. After installation and during use of such a barrier apparatus 20 with a removable assembly comprising, consisting essentially of, or consisting of the barrier post 26, frame's inner plate 78, and braces 27, 130, after unlocking and removing a cover 28, or the like, the removable assembly 26, 78, 27, 130 can be removed from the remainder of the barrier apparatus 20 by authorized personnel for allowing passage of one or more vehicles, or the like. Thereafter the barrier apparatus 20 can be reassembled. In such a partially removably barrier apparatus 20 the mating slots 100 of the frame's right and left plates 72, 74 can be upwardly open and/or other suitable accommodations can be made.

Reiterating from above, it is within the scope of this disclosure for one or more of the terms "substantially," "about," "approximately," and/or the like, to qualify each of the adjectives and adverbs of the foregoing disclosure, for the purpose of providing a broad disclosure. As an example, it is believed that those of ordinary skill in the art will readily understand that, in different implementations of the features of this disclosure, reasonably different engineering tolerances, precision, and/or accuracy may be applicable and suitable for obtaining the desired result. Accordingly, it is believed that those of ordinary skill will readily understand usage herein of the terms such as "substantially," "about," "approximately," and the like.

In the specification and drawings, examples of embodiments have been disclosed. The present invention is not limited to such exemplary embodiments. The use of the term "and/or" includes any and all combinations of one or more of the associated listed items. Unless otherwise noted, specific terms have been used in a generic and descriptive sense and not for purposes of limitation.

The invention claimed is:

1. A barrier apparatus comprising:

a base comprising a base plate, the base being configured to be at least partially embedded in concrete;

a barrier post mounted to the base and extending upwardly from the base; and a brace configured to restrict relative movement between the barrier post and the base plate, wherein the brace is mounted to the base and extends upwardly and obliquely toward the barrier post, so that the brace extends obliquely between the base and the barrier post, and wherein at least a portion of the brace is configured to extend to an elevation above an upper surface of concrete that at least partially covers the base;

wherein the brace comprises a tube extending around a block and an annular, elongate interior surface of the tube conforms to an annular, elongate outer surface of the block.

2. The barrier apparatus according to claim claim 1, wherein the brace extends at least partially into a rear corner positioned between the barrier post and the base.

3. The barrier apparatus according to claim claim 1 in combination with concrete, wherein:

the base is at least partially embedded in the concrete so that the concrete at least partially covers the base; and at least a portion of the brace extends to an elevation above an upper surface of the concrete that at least partially covers the base.

4. The barrier apparatus according to claim claim 1, comprising a mating protrusion extending from the brace into a mating hole in the base.

5. The barrier apparatus according to claim 4, wherein the mating protrusion extends from the block.

6. The barrier apparatus according to claim claim 1, wherein:

the base plate is an upper base plate;

the base further comprises a lower base plate; and a mating protrusion extends from the brace, through a mating hole in the upper base plate, and into a mating hole in the lower base plate.

7. The barrier apparatus according to claim claim 1, comprising:

an upright plate positioned between the brace and the barrier post; and a mating protrusion extending from the brace into a mating hole in the upright plate.

8. The barrier apparatus according to claim claim 1, wherein the brace is spaced apart from a rear corner positioned between the barrier post and the base.

9. The barrier apparatus according to claim 8, wherein the brace is a first brace, and the barrier apparatus further comprises a second brace extending into the rear corner positioned between the barrier post and the base.

10. A barrier apparatus comprising:

a base comprising a base plate, the base being configured to be at least partially embedded in concrete;

a barrier post mounted to the base and extending upwardly from the base;

a brace configured to restrict relative movement between the barrier post and the base plate, wherein the brace is mounted to the base and extends upwardly and obliquely toward the barrier post, so that the brace extends obliquely between the base and the barrier post, and wherein at least a portion of the brace is configured to extend to an elevation above an upper surface of concrete that at least partially covers the base; and a frame comprising a plurality of plates extending at least partially around an interior space, wherein both the barrier post and the brace are at least partially positioned in the interior space.

11. The barrier apparatus according to claim 10, further comprising a rigid cover configured to fit over both the barrier post and the frame.

12. The barrier apparatus according to claim 10, wherein the barrier post extends through the interior space and into a hole in the base plate.

13. The barrier apparatus according to claim 10, comprising an inner plate positioned in and at least partially dividing the interior space, wherein the inner plate is positioned between at least a portion of the barrier post and at least a portion of the brace.

14. The barrier apparatus according to claim 10, wherein:

the plurality of plates are respectively connected to one another;

at least some of the plurality of plates are connected to the base plate;

for each of at least some of a plurality of connections respectively between the plurality of plates, the connection comprises a portion of a plate of the plurality of plates extending into a cavity of an other plate of the plurality of plates; and the plate and the other plate extend crosswise to one another.

15. The barrier apparatus according to claim 10, wherein the plurality of plates comprises:

opposite front and rear plates that are spaced apart from one another;

right and left plates that are spaced apart from one another and extend between the front and rear plates; and an inner plate positioned in and at least partially dividing the interior space, wherein:

the inner plate is positioned between at least a portion of the barrier post and at least a portion of the angle brace; and the inner plate is positioned between, and spaced apart from each of, the front and rear plates.

16. A barrier apparatus comprising:

a base comprising a base plate, the base being configured to be at least partially embedded in concrete;

a barrier post mounted to the base and extending upwardly from the base; and a brace mounted between the barrier post and the base plate, and configured to restrict relative movement between the barrier post and the base plate, wherein:

a mated connection to the front of the brace comprises a first mating protrusion extending into a first mating hole, and a mated connection to the bottom of the brace comprises a second mating protrusion extending into a second mating hole;

wherein the brace comprises a tube extending around a block and the mating protrusions extend from the block.

17. The barrier apparatus according to claim 16, wherein:

the first mating protrusion extends from a front of the brace; and the first mating hole is defined in a plate mounted to the barrier post.

18. The barrier apparatus according to claim 16, wherein:

the second mating protrusion extends from a bottom of the brace; and the second mating hole is defined in the base.

19. A barrier apparatus comprising:

a base comprising a base plate, the base being configured to be at least partially embedded in concrete;

a barrier post mounted to the base and extending upwardly from the base; and a brace comprising a block configured to restrict relative movement between the barrier post and the base plate, wherein the brace is mounted to the base and extends at least partially into a rear corner positioned between the barrier post and the base;

wherein the brace is triangular, and further comprising an oblique surface of another brace extending along an inclined surface of the triangular brace.

20. The barrier apparatus according to claim 19, wherein the brace is polygonal.

21. A barrier apparatus comprising:

a base comprising a base plate, wherein the base is configured to be at least partially embedded in concrete;

a barrier post mounted to the base and extending upwardly from the base; and a brace comprising a tube extending around a block and a mating protrusion extending from the block into a mating hole in the base, wherein:

the brace is mounted to the base and extends upwardly and obliquely toward the barrier post such that the brace extends obliquely between the base and the barrier post;

at least a portion of the brace is configured to extend to an elevation above an upper surface of concrete that at least partially covers the base; and the brace is configured to restrict relative movement between the barrier post and the base plate.

22. A barrier apparatus comprising:

a base comprising an upper base plate and a lower base plate, the base being configured to be at least partially embedded in concrete;

a barrier post mounted to the base and extending upwardly from the base; and a brace comprising a mating protrusion that extends from the brace, through a mating hole in the upper base plate, and into a mating hole in the lower base plate, wherein:

the brace is mounted to the base and extends upwardly and obliquely toward the barrier post such that the brace extends obliquely between the base and the barrier post;

at least a portion of the brace is configured to extend to an elevation above an upper surface of concrete that at least partially covers the base; and the brace is configured to restrict relative movement between the barrier post and the base plate.

23. A barrier apparatus comprising:

a base comprising a base plate, wherein the base is configured to be at least partially embedded in concrete;

a barrier post mounted to the base and extending upwardly from the base;

a brace comprising a tube extending around a block and a mating protrusion extending from the block; and an upright plate positioned between the brace and the barrier post, the upright plate comprising a mating hole into which the mating protrusion of the brace extends;

wherein the brace is mounted to the base and extends upwardly and obliquely toward the barrier post such that the brace extends obliquely between the base and the barrier post;

wherein at least a portion of the brace is configured to extend to an elevation above an upper surface of concrete that at least partially covers the base; and wherein the brace is configured to restrict relative movement between the barrier post and the base plate.

* * * * *